US008021241B2

(12) United States Patent
Graga et al.

(10) Patent No.: US 8,021,241 B2
(45) Date of Patent: Sep. 20, 2011

(54) GOLF TRAINING AID FOR CHIPPING AND PITCHING

(76) Inventors: Robert Graga, Brick, NJ (US); Brian Russer, Mesa, AZ (US)

( * ) Notice: Subject to any disclaimer, the term of this patent is extended or adjusted under 35 U.S.C. 154(b) by 67 days.

(21) Appl. No.: 12/655,232

(22) Filed: Dec. 28, 2009

(65) Prior Publication Data

US 2010/0203978 A1 Aug. 12, 2010

Related U.S. Application Data

(60) Provisional application No. 61/207,102, filed on Feb. 9, 2009.

(51) Int. Cl.
*A63B 69/36* (2006.01)

(52) U.S. Cl. ..... 473/172; 473/165; 473/195

(58) Field of Classification Search ..... 473/165, 473/193, 172, 170, 195–197; 273/398–402
See application file for complete search history.

(56) References Cited

U.S. PATENT DOCUMENTS

| | | | | | |
|---|---|---|---|---|---|
| 507,098 | A * | 10/1893 | Bates | 273/401 |
| 1,469,130 | A * | 9/1923 | Whitehair | 473/194 |
| 1,719,240 | A * | 7/1929 | Scanlan | 473/190 |
| 2,455,185 | A * | 11/1948 | May | 473/195 |
| 2,563,057 | A * | 8/1951 | Neininger | 273/402 |
| 2,647,747 | A * | 8/1953 | Kenney et al. | 273/402 |
| 2,827,297 | A * | 3/1958 | Foster | 273/401 |
| 3,328,033 | A * | 6/1967 | Hendry | 473/184 |
| 3,558,140 | A * | 1/1971 | Romeo | 473/164 |
| 3,594,006 | A * | 7/1971 | Clatt | 473/154 |
| 3,601,406 | A * | 8/1971 | Giusti | 473/160 |
| 3,820,789 | A * | 6/1974 | Dudley | 273/400 |
| 3,880,427 | A * | 4/1975 | Bingham | 473/471 |
| 4,057,252 | A * | 11/1977 | Pelton | 273/400 |
| 4,215,865 | A * | 8/1980 | Pilati | 473/153 |
| 4,395,042 | A * | 7/1983 | Boswell | 473/195 |
| 4,984,809 | A * | 1/1991 | Chiang | 273/401 |
| 5,037,095 | A * | 8/1991 | Nedwick | 473/439 |
| 5,062,640 | A * | 11/1991 | Haley | 473/168 |
| 5,536,017 | A * | 7/1996 | Salisian | 273/375 |
| 5,549,302 | A * | 8/1996 | Lapsker et al. | 473/416 |
| 5,655,972 | A * | 8/1997 | Heitzman | 473/172 |
| 5,984,793 | A * | 11/1999 | Palombi | 473/195 |
| 6,679,498 | B2 * | 1/2004 | Barniak, Jr. | 273/402 |
| 6,769,993 | B1 * | 8/2004 | Lasalandra | 473/193 |
| 6,905,418 | B2 * | 6/2005 | Rhee | 473/197 |
| 2003/0144066 | A1 * | 7/2003 | Bird | 473/172 |

* cited by examiner

*Primary Examiner* — Mark Graham
(74) *Attorney, Agent, or Firm* — Clifford G. Frayne

(57) ABSTRACT

A golf training aid which incorporates a standard golf club, with a Nerf golf ball or a whiffle golf ball, and a target which is hung on the wall at adjustable heights, the target having a backboard removable secured to the wall, a face board positioned forward of the backboard, the face board having an aperture there through, the aperture in communication with a cavity positioned between said face board and said backboard for the collection of a Nerf golf ball or whiffle golf ball whose trajectory from the golf club has carried it through the aperture and into the cavity.

7 Claims, 3 Drawing Sheets

GOLF TRAINING AID FOR CHIPPING AND PITCHING

RELATED APPLICATIONS

Applicant claims the benefit of provisional application Ser. No. 61/207,102, filed Feb. 9, 2009.

BACKGROUND OF THE INVENTION

1. Field of the Invention

The present invention relates to the sport of golf, and more particularly, to a golf training aid for pitching and chipping which can but utilized indoors and year round to allow a golfer to become more proficient with his chipping and pitching skills.

2. Description of the Prior Art

Golf is an extremely popular outdoor sport and form of exercise, but unfortunately in many areas of the world it can only be played during a portion of the year due to temperature and weather. Still further, it cannot be played during extremely inclement weather. The sport itself requires extensive acreage in order to lay out a course, be it nine holes or 18 holes, and even practice facilities require substantial acreage in order to allow the golfer to utilize all of the clubs in his bag for practice.

The popularity of the sport has led to indoor practice facilities in which the golfer strikes a golf ball into a net or tarp. In such a facility the golfer's swing can be videotaped and electronics have been developed which can provide feedback to the golfer regarding the shape and distance of the shot which he has struck into the net or tarp. However, these indoor facilities require substantial space and are expensive such that they are out of the price range of most golfers.

Golfers can be seen practicing their putting on the living room carpet or on the office carpet, but there has been a need for a training aid or practice device that the ordinary golfer can utilize in his home or in his garage any time of the year which would allow the golfer to hone his pitching and chipping skills without the need for moving furniture or moving valuables or damaging walls, floors, or the contents of the room. Applicant's training aid allows the golfer to practice and hone his chipping and pitching skills with very little area requirements and obviates the possibility of breakage of valuables through the use of Nerf and/or whiffle balls, and the training aid is also adaptable to a competitive game between two or more golfers.

OBJECTS OF THE INVENTION

An object of the present invention is to provide for a novel golf training aid which can be used indoors and year round utilizing conventional golf clubs and a Nerf golf ball or a whiffle golf ball, together with an adjustable target.

A still further object of the present invention is to provide for a novel golf training aid, the target of which is adjustable in height on a wall in order to allow for the golfer to utilize different lofted clubs.

A still further object of present invention is to provide for a novel golf training aid which allows the golfer to hone his chipping and pitching skills, and is further adaptive to a competitive game between two or more golfers.

SUMMARY OF THE INVENTION

A golf training aid which incorporates a standard golf club, with a Nerf golf ball or a whiffle golf ball, and a target which is hung on the wall at adjustable heights, the target having a backboard removable secured to the wall, a face board positioned forward of the backboard, the face board having an aperture there through, the aperture in communication with a cavity positioned between said face board and said backboard for the collection of a Nerf golf ball or whiffle golf ball whose trajectory from the golf club has carried it through the aperture and into the cavity.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
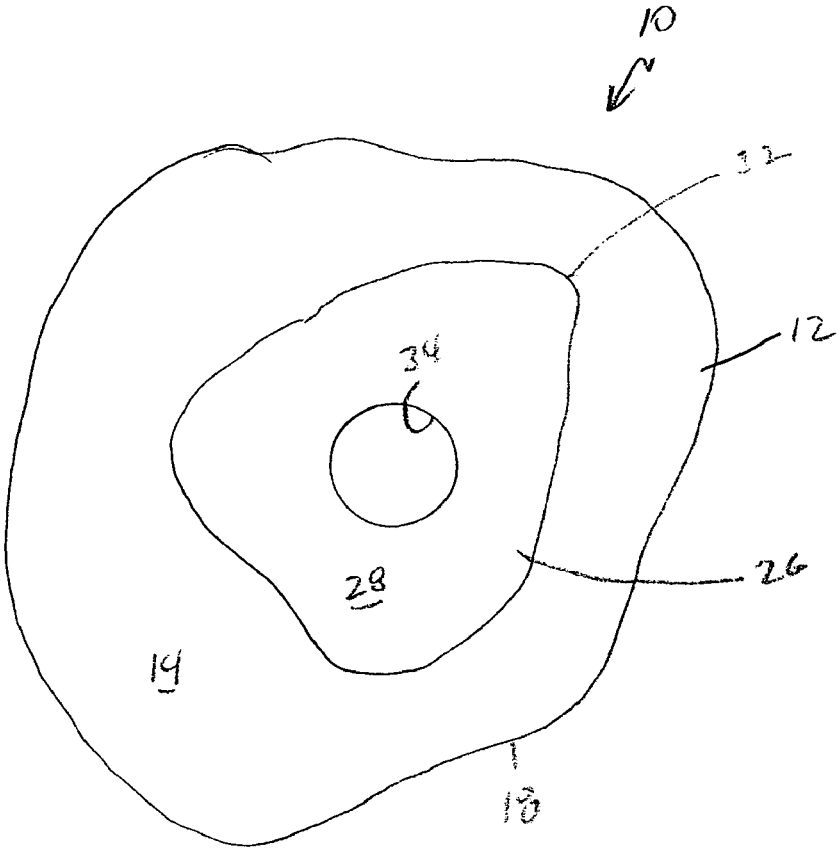
FIG. 1 is a front view of the target portion of the golf training aid of the present invention.
Figure 2:
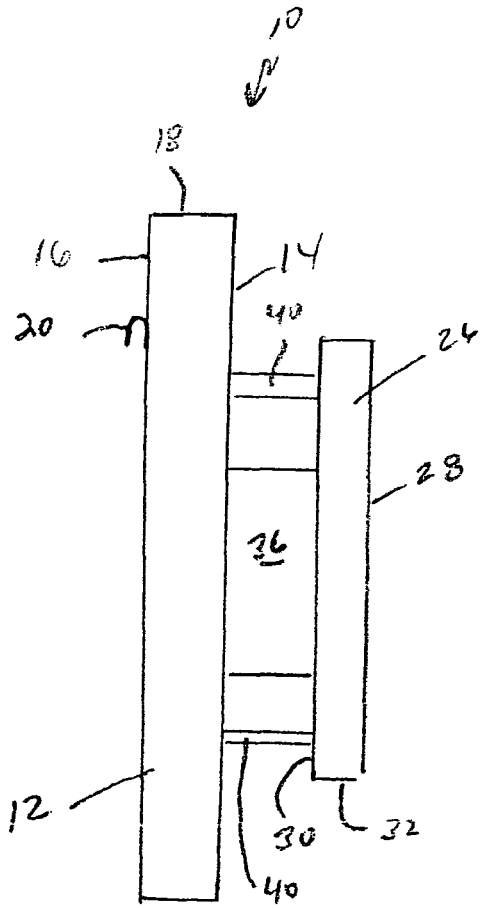
FIG. 2 is a side view of the target portion of the golf training aid of the present invention.

FIG. 1 is a front view of the target portion 10 of the golf training aid of the present invention and FIG. 2 is a side view of the target portion 10 of the golf training aid of the present invention. The target portion 10 comprises a backboard member 12 having a front face 14 and a rear face 16 and a peripheral edge 18. Affixed to the rear face 16 is a securing means 20 in the form of a hook, wire, or the like, which allows the base member 12 to be secured to a vertical surface 22 such as a wall or post (See FIG. 3).

Target portion 10 further includes a face board member 26 having a front face 28 and a rear face 30 and peripheral edge 32. Face board member 26 is formed with an aperture 34 there through. Positioned between the front face 14 of backboard member 12 and the rear face 30 of face board member 26 is a receptacle member 36. Receptacle member 36 is aligned with the aperture 34 in face board member 26 and the front surface 14 of backboard member 12 which serves as the closure to the rear portion of receptacle member 36. Receptacle member 36 therefore defines a cavity for receipt of a Nerf golf ball or whiffle golf ball as more fully explained hereafter.

The peripheral shape of the backboard member 12 and the peripheral shape of the face board member 26 may be geometric, but for the purposes of aesthetics with respect to the golf training aid, the preferred shapes would be irregular with face board member 26 being painted or tinted a shade of green so as to resemble a golf putting green and backboard member 12 being painted or tinted a different shade of green to depict fairway grass.

In most instances, the receptacle member 36 secured between the front face 14 of backboard member 12 and the rear face 30 of face board member 26 will be sufficient to maintain the face board member and its aperture 34 in position. However, additional support rods 40 may be utilized to secure the face board member 26 to backboard member 12.

The dimensions of the golf training aid may vary, but its intended purpose is to be movable and adjustable in height so that the golfer may utilize clubs of varying loft. In the preferred embodiment, the backboard member having an irregular shape, would have a maximum width of 22 inches and a maximum height of 22 inches. The face board member of irregular shape would have a maximum width of 13 inches and a maximum height of 13 inches. The aperture 34 in face board member 26 would have a preferred diameter of four inches, equal to that of a standard golf hole, but this dimension may be varied. The receptacle member 36 may vary in depth and will have a diameter greater than that of aperture 34. The depth of the receptacle member 36 should be such that a Nerf golf ball or whiffle golf ball (dimensions to actual golf ball size) which passes through aperture 34 will be retained within the receptacle 36.

Figure 3:
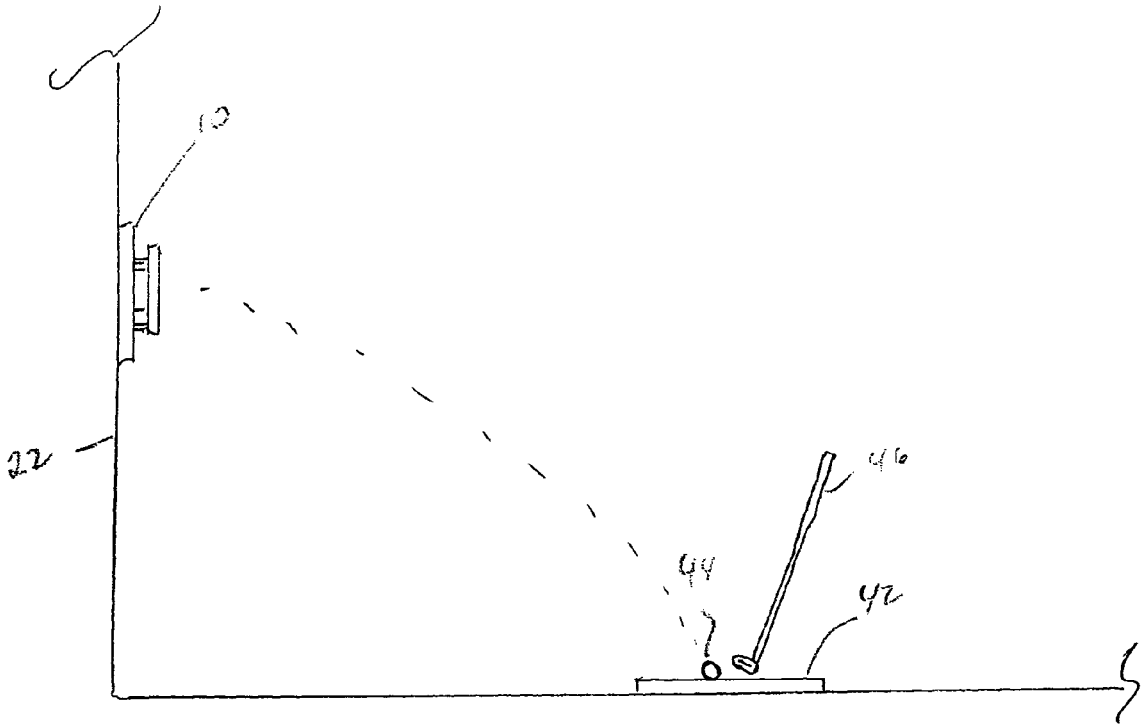
FIG. 3 is a side view of the positioning of the target, Nerf golf ball or whiffle golf ball and golf club for training purposes.

FIG. 3 is a side view of the target portion 10 being secured to a vertical surface 22. The golfer or user would utilize a piece of carpet remnant or artificial turf 42 upon which to place the Nerf golf ball or whiffle golf ball 44 and strike it with a lofted pitching or chipping iron 46.

In an actual round of golf, the delicate art of pitching and chipping normally takes place around the green with the golfer expending effort in order to chip the golf ball from off of the green onto the green and have the ball come to rest either in the cup or close to the cup.

In an actual round of golf, the type of lie which the golfer encounters for the ball, the distance the ball from the green, the distance from the ball to the actual hole, and the existence of any hazards between the ball and the green all factor into the determination of what type of club and what kind of pitch or chip shot the golfer will attempt to undertake. Still further, normally around the green, the golfer will not be required to take a full swing, but rather, a half or three quarter swing in order to obtain the desired trajectory and distance dependent upon the loft of the club chosen.

If the golfer is relatively close to the green with no hazards between himself and the green, the golfer may choose to use a less lofted iron such as a six iron in order to strike the ball on a lower trajectory so that it lands on the green and rolls the remaining distance to the cup or the area around the cup. Conversely, if the golfer finds himself in a thick lie, or the contour of the green does not lend itself to the chip and run shot previously described, the golfer will take a more lofted club, such as a nine iron, pitching wedge, or 60 degree wedge, and attempt a higher trajectory of shot attempting to land and stop the ball proximate the hole. The actual conditions on a golf course may dictate further inventive shots between the two described.

Figure 4:
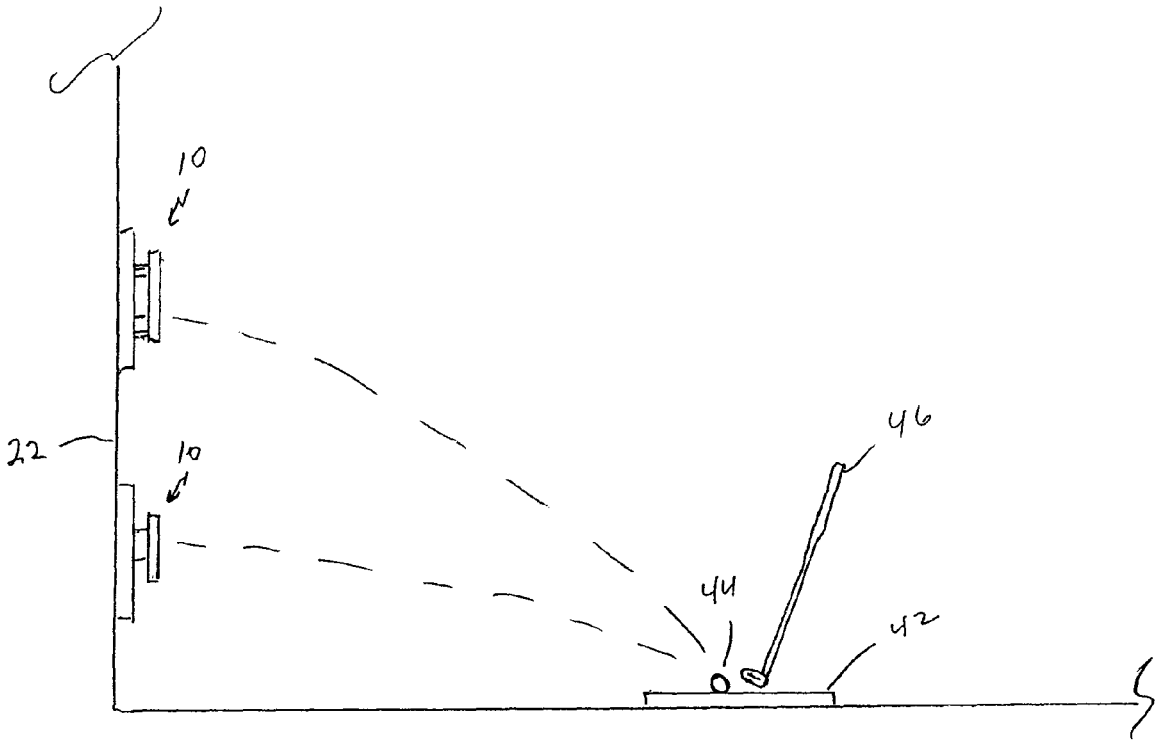
FIG. 4 is a side view of the positioning of multiple targets for training purposes.

The golf training aid of the present invention allows the golfer to practice indoors and year round. The chip and run shot or the pitch shot described are practiced by adjusting the height of the target portion 10 and the distance from the vertical surface 22 which the target portion is mounted to the carpet remnant or artificial turf 42 on which the Nerf golf ball or whiffle golf ball 44 is placed (See FIG. 4). The golfer may choose to lower the target portion 10 and place the carpet remnant or artificial turf 42 and the Nerf golf ball and whiffle golf ball 44 closer to the target portion 10 to practice the chip and run shot and conversely may raise the target portion 10 and move rearwardly away from vertical surface 22 to practice a pitch shot. Alternatively the user may mount several targets simultaneously at varied heights. In testing, the Applicant has found that the optimum height for the target portion 10 for the pitch shot would be 5'8", to 6' measured to the center of the aperture 34 on face board member 26. At such a height the preferred distance from the vertical surface 22 on which the target portion 10 is mounted would be 8 feet for the execution of a shot with a lofted iron such as a nine iron, pitching wedge, or lob wedge. Lower heights and closer distance could be adjusted for clubs of less loft.

A single target portion 10 of the type described could be used by a golfer within his home or within his garage year round regardless of the weather. The target portion 10 of the type described could also be used within a golf club house or within a golf pro shop, where a golfer might be considering the purchase of a new iron or irons, and wishes to obtain the feel of the swing before purchase. Still further, a single target portion 10 may be utilized or multiple target portions 10 may be positioned on a common vertical surface at different heights and spaced apart so as to allow multiple golfers to practice simultaneously.

Still further, the target portion 10, together with associated Nerf golf ball or whiffle golf ball 44 and golf club 46, can lend itself to competition between two or more golfers attempting to execute identical shots from one or more distances with one or more clubs and developing a scoring system based upon the resultant shot and the location of the Nerf golf ball or the whiffle golf ball 44 (e.g. in the hole for a hole-in-one, striking the front face member for a birdie, or striking the rear base member for a par).

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

We claim:

1. A golf training aid for practicing one's chipping and pitching of a golf ball, the golf training aid comprising:

a standard golf club having a lofted face;

a projectile in the form of a pseudo golf ball having high drag, low velocity, limited distance characteristics;

a mat positioned on a horizontal surface for the placement of the pseudo golf ball and the striking of same with said golf club;

a target positioned on a vertical wall a selected distance from said mat, said target comprising a backboard having a rear face and a front face, said rear face juxtaposed said vertical wall;

a face board disposed in spaced apart relationship from said front face of said backboard, defining a receptacle cavity there between said face board having an aperture there through in communication with said receptacle cavity for the receipt and retention of said pseudo golf ball struck by said golf club and the removal of said pseudo golf ball by hand;

a securing means for securing said target to said wall.

2. The golf training aid for chipping and pitching in accordance with claim 1 wherein said aperture in said face board is dimensioned minimally to that of a standard golf hole.

3. The golf training aid for chipping and pitching in accordance with claim 1 wherein said backboard is of a larger diameter than said face board and has a different tint or shade of color from said face board for depth perception.

4. The golf training aid for chipping and pitching in accordance with claim 1 wherein said face board is of an irregular shape.

5. The golf training aid for chipping and pitching in accordance with claim 1 wherein said mat comprises a rug remnant or artificial turf.

6. The golf training aid for chipping and pitching in accordance with claim 1 wherein multiples of said target may be positioned on said vertical wall at varying heights.

7. The golf training aid for chipping and pitching in accordance with claim 1 wherein said selected distance from said mat to said target and height of said target is selectively adjusted dependent upon said lofted face of said golf club.

* * * * *